US011142953B2

(12) United States Patent
Koskinen et al.

(10) Patent No.: US 11,142,953 B2
(45) Date of Patent: Oct. 12, 2021

(54) ROCK DRILLING ARRANGEMENT, ROCK DRILLING RIG AND DRILLING METHOD

(71) Applicant: SANDVIK MINING AND CONSTRUCTION OY, Tampere (FI)

(72) Inventors: Kimmo Koskinen, Tampere (FI); Tero Yli-Hannuksela, Tampere (FI); Jukka Simila, Tampere (FI); Tapio Makinen, Tampere (FI); Toni Hietikko, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 16/790,470

(22) Filed: Feb. 13, 2020

(65) Prior Publication Data

US 2020/0263499 A1 Aug. 20, 2020

(30) Foreign Application Priority Data

Feb. 14, 2019 (EP) ..... 19157067

(51) Int. Cl.
*E21B 7/02* (2006.01)
*E21B 7/00* (2006.01)
*E21B 7/04* (2006.01)

(52) U.S. Cl.
CPC ..... *E21B 7/025* (2013.01); *E21B 7/002* (2013.01); *E21B 7/022* (2013.01); *E21B 7/027* (2013.01); *E21B 7/046* (2013.01)

(58) Field of Classification Search
CPC ..... E21B 7/022; E21B 7/025; E21B 7/046
See application file for complete search history.

(56) References Cited

U.S. PATENT DOCUMENTS

2010/0294570 A1* 11/2010 Saf ..... E21B 7/025 175/122
2011/0070035 A1* 3/2011 Ricardo ..... E21D 21/0053 405/259.5
2018/0119492 A1* 5/2018 Nelson ..... E21B 7/023

FOREIGN PATENT DOCUMENTS

| | | | |
|---|---|---|---|
| CL | 58857 | | 3/2020 |
| CN | 203201465 | U | 9/2013 |
| CN | 203420633 | U | 2/2014 |
| DE | 19641922 | C1 | 10/1997 |
| GB | 1583574 | A | 4/1999 |
| JP | H07189582 | A | 7/1995 |
| JP | H11117656 | A | 4/1999 |
| JP | 2004143740 | A | 5/2004 |
| WO | 02103162 | A1 | 12/2002 |
| WO | 2011129760 | A1 | 10/2011 |

* cited by examiner

*Primary Examiner* — Tara Schimpf
(74) *Attorney, Agent, or Firm* — Corinne R. Gorski

(57) ABSTRACT

A rock drilling arrangement, rock drilling rig and drilling method is provided. The rock drilling arrangement includes a drilling boom, which is mountable to a carrier of the rock drilling rig. The boom is provided with two rock drilling units arranged movably in the longitudinal direction of the boom. Further, the drilling units may be moved independently relative to each other.

10 Claims, 3 Drawing Sheets

ROCK DRILLING ARRANGEMENT, ROCK DRILLING RIG AND DRILLING METHOD

RELATED APPLICATION DATA

This application claims priority under 35 U.S.C. § 119 to EP Patent Application No. 19157067.0, filed on Feb. 14, 2019, which the entirety thereof is incorporated herein by reference.

TECHNICAL FIELD

The invention relates to a rock drilling arrangement for drilling drill holes to rock surfaces. The invention further relates to a rock drilling rig and method.

BACKGROUND

In mines, construction sites and at other work areas different type of rock drilling rigs are used. The rock drilling rigs are provided with one or more drilling booms and rock drilling units are arranged at distal ends of the booms for drilling drill holes. The purpose of drilling holes in rock may be for forming blast holes for detaching rock material by blasting, or the drill holes may be drilled in order to reinforce the rock surface by mounting rock bolts or other reinforcements inside the drilled holes. Typically, a great number of drill holes needs to be drilled in both cases. The present rock drilling arrangements have shown to contain some disadvantages especially regarding their productivity.

SUMMARY

An object of the invention is to provide a novel and improved rock drilling arrangement, rock drilling rig and method for rock drilling.

An idea of the disclosed solution is that a rock drilling rig includes a single drilling boom and the boom is provided with a freely movable tandem drilling unit system. Thereby, the drilling boom includes two drilling units, which can be positioned independently to desired positions relative to each other. The drilling units may be moved independently, which means that trajectories of the drilling unit are separate and do not cross. In other words, the drilling units are free to pass each other.

An advantage of the disclosed solution is that when two drilling units can be moved and positioned independently to desired positions, the operation of the device is flexible and increased productivity is achieved. The drilling units do not need to wait for each other since they may pass each other, and further, their movement ranges are not limited by each other. Proper positions can be freely selected for the drilling units to execute the drilling of a planned drilling pattern. This way the rock drilling may be executed in a quick and efficient manner.

According to an embodiment, both rock drilling units include a feed beam and a rock drilling machine supported movably on the feed beam.

According to an embodiment, the disclosed solution is intended for reinforcing rock surface.

According to an embodiment, the disclosed solution is intended for drill and blast excavation method.

According to an embodiment, the drilling units are movable vertically during their operation. Thus, the drilling boom includes at least one vertically directed part for supporting the drilling units and allowing their vertical movement.

According to an embodiment, the disclosed solution is intended for so called fan-drilling, wherein several drill holes are drilled to the rock surface so that the drill holes form a kind of fan-shaped pattern comprising drill holes directed laterally and drill holes directed upwards. The drill holes of the fan may be charged with explosives or they may receive reinforcing bolts.

According to an embodiment, both rock drilling units have moving range in a longitudinal direction of the drilling boom. The rock drilling units are independently movable in the longitudinal direction of the drilling boom for the full moving range all the time. When the drilling units can be driven between their extreme positions without limitations, the solution has good reach. The length of the available moving range may be the same for both drilling units.

According to an embodiment, the drilling units are movable simultaneously and in any longitudinal direction on their own linear guide surfaces. The design of the drilling boom is firm enough, or the boom is additionally supported to the surrounding surfaces, so that both drilling units may be moved without causing stability problems. The two drilling units may also drill and perform their other work steps simultaneously at the same time without disturbing each other.

According to an embodiment, one or both of the mentioned two rock drilling units include feed means for feeding reinforcing components to a drill hole drilled by means of a rock drilling machine of the rock drilling unit. In other words, the drilling unit includes means for making holes and for providing them with reinforcements.

According to an embodiment, the feed means discussed above is configured to manipulate elongated rock bolts. The manipulation may include storing, handling, feeding and tightening measures.

According to an embodiment, the above mentioned reinforcing component to be fed inside the drilled hole is one of the following: a rock bolt, self-drilling anchoring bolt, reinforcing cable, injection material. Thus, there are several alternative ways to reinforce rock surfaces.

According to an embodiment, the rock drilling units are mounted on carriages, which are movable independently relative to the boom. Further, between the carriages and the drilling units are rotation units for turning the rock drilling units independently relative to the boom. The carriages are moved in longitudinal direction of the boom and rotation axis of the rotation units are perpendicular relative to the movement direction of the carriages.

According to an embodiment, the drilling boom includes a first side facing towards a forward moving direction of a rock drilling rig and an opposite second side facing towards a rearward moving direction. The above-mentioned first carriage is mounted on the first side and the second carriage is mounted on the opposing second side. Thus, the carriages are located on opposite sides of the drilling boom. This way the carriages are free to move on their own sides and they do not disturb each other.

According to an embodiment, the rotation unit, which is located between the carriage and the drilling unit, includes at least a rotation motor. The rotation motor may be a hydraulic motor. In some cases the rotation motor may alternatively be an electric motor. Further, the rotation unit may include only the motor or it may be a combination of a rotation gear and the rotation motor.

According to an embodiment, the drilling boom has a two-part configuration. The drilling boom includes a first boom part connectable to a movable carrier of a rock drilling rig, and a distal second boom part. Between the boom parts is a joint, whereby the second boom part can be turned relative to the first boom part. Further, the two rock drilling units are mounted on opposing side surfaces of the second boom part and are movable in longitudinal direction of the second boom part.

According to an embodiment, the drilling boom includes the first boom part and the distal second boom part as it is disclosed in the previous embodiment above. Further, the boom is designed to be orientated during the operation so that the second boom part is orientated transversally relative to the first boom part.

According to an embodiment, the first boom part is configured to be orientated horizontally, or substantially horizontally, during the operation of the rock drilling units. The second boom part is configured to be orientated vertically, or substantially vertically, during the operation. The horizontal first boom part may be supported against ground or bottom surface whereby the boom is stable.

According to an embodiment, the second boom part is tiltable forwards and backwards relative to the horizontal joint, which is located between the boom parts. Thus, the second boom part and the drilling units may be easily orientated and drill holes may be drilled according a drilling plan.

According to an embodiment, in order to improve stability the mentioned horizontal first boom part may be supported against the ground during the drilling operation. Furthermore, the second boom part may have one or more extendable support elements for supporting the boom to the rock surface. The support element may be a telescopic structure or a hydraulic cylinder. The extendable support may be movable vertically, whereby it may be pushed against a ceiling of a tunnel or corresponding rock space.

According to an embodiment, the drilling boom has a transport position and an operational position. The first and second boom parts may be moved to the transport position, wherein the first boom part is lifted upwards at a distance from the ground level and the second boom part is tilted backwards towards the carrier of the rock drilling rig. The operational position has already disclosed above.

According to an embodiment, the drilling boom includes a first boom part connectable to a carrier of a rock drilling rig, and a distal second boom part. The second boom part includes a frame and first and second elongated guide elements supported to the frame. A first carriage is supported linearly movably to the first guide element and a second carriage is supported linearly movably to the second guide element. The carriages are moved relative to the frame by means of dedicated actuators. Due to the above-mentioned dedicated guide elements, carriages and actuators the drilling units may be freely positioned to desired operational positions in the longitudinal direction of the vertically, or substantially vertically orientated second boom part. In other words, the drilling units may be driven to desired height positions in order to execute their work cycle with good performance.

According to an embodiment, the second boom part includes two first guide elements and two second guide elements for supporting the carriages. The two first guide elements are located at a transverse distance from each other, and similarly, the two second guide elements are located at a transverse distance from each other. The disclosed structure provides stabile and accurate movement for the drilling units.

According to an embodiment, the above-mentioned guide elements of the second boom part are round bars or tubes. Thus, the structure may be simple with round surfaces of the guide elements provide good slide surfaces.

According to an embodiment, the above-mentioned first and second actuators for moving the carriages are hydraulic cylinders.

According to an embodiment, the second boom part includes a frame having two longitudinal beams at a transverse distance from each other and connected to each other at their first and second ends by means of transverse frame parts. Thus, the frame has a rectangle form framing a device space provided with the above-mentioned guide elements and cylinders. The disclosed frame structure may be relatively light in weight and still firm, and further, the guide bars and cylinders are easy to mount between the transverse portions of the frame. The guide bars mounted between the transverse portions of the frame may provide additional support for the frame structure. Further, the rectangular frame configuration of the second boom part also provides shelter for the moving components mounted inside the device space between its framing bars and structures.

According to an embodiment, the second boom part includes a frame having two transverse beams or frame parts disposed at a distance from each other. The transverse frame parts are connected to each other by means of the guide bars mentioned above. Thus, in this solution the second boom part may be without separate longitudinal frame bars. An advantage is that weight of the second boom may be reduced and the structure is compact.

According to an embodiment, the solution relates to a rock drilling rig having a movable carrier, a drilling boom and two rock drilling units supported longitudinally movably on the drilling boom. The drilling boom and the rock drilling units are in accordance with the features disclosed in this document. The drilling boom is provided with a tandem drilling system wherein two drilling units are operable and movable independently relative to each other, whereby the two drilling units may operate freely relative to each other and effective drilling is achieved. One single boom is needed, and still, two drilling units are offered.

According to an embodiment, the solution relates to a method for drilling drill holes to a rock surface by means of a rock drilling arrangement including one drilling boom and two rock drilling units supported on the drilling boom. The method includes moving the two drilling units in the longitudinal direction of the drilling boom and executing the movements independently relative to each other. During the drilling the boom may be positioned so that a part of the drilling boom is vertically, or substantially vertically, orientated and the drilling units move vertically when being positioned along the drilling boom.

According to an embodiment, selecting vertical positions for both drilling units freely from their dedicated full linear movement ranges at all times during the drilling operation. Thus, the entire movement potential is availably selectable for the positioning.

According to an embodiment, the method includes moving one of the drilling units freely in the longitudinal direction of the drilling boom simultaneously when the other drilling unit executing its own work cycle, such as drilling.

The above disclosed embodiments may be combined in order to form suitable solutions having those of the above features that are needed.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION

Figure 1:
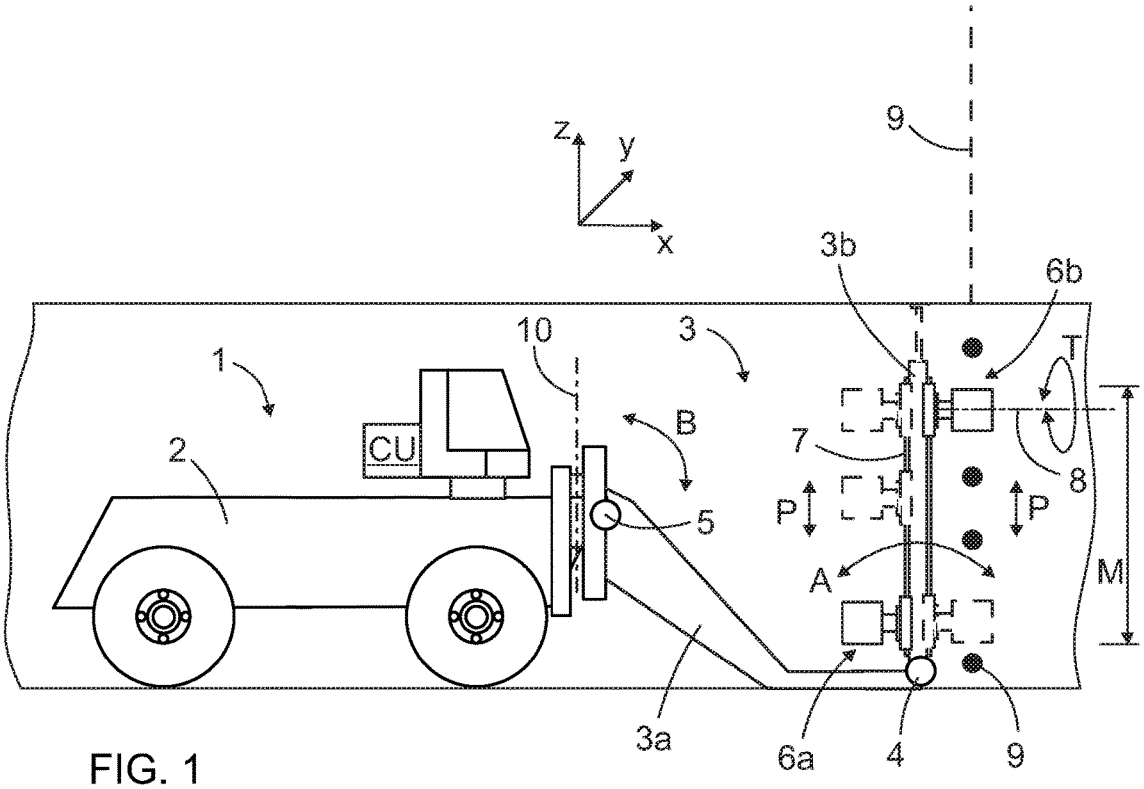
FIG. 1 is a schematic side view of a rock drilling rig provided with a drilling boom with tandem drilling units.

FIG. 1 shows a rock drilling rig 1. The rock drilling rig 1 includes a movable carrier 2 and one drilling boom 3. The boom 3 includes a first boom part 3*a* connected to the carrier 2 and a second boom part 3*b* connected to the first boom part 3*a* by a joint 4, whereby the second boom part 3*b* may be turned in direction A to a desired position. The first boom part 3*a* may be turned as shown by direction B relative to a joint 5.

During operation, the first boom part 3*a* may be horizontally orientated and may be supported on the ground or bottom surface. The second boom part 3*b* can be vertically orientated and includes two drilling units 6*a*, 6*b*. The second boom part 3*b* is provided with guide surfaces 7 along which the drilling units 6*a*, 6*b* may be moved as shown by P longitudinally on opposite sides of the second boom part 3*b*. The drilling units 6*a*, 6*b* have movement ranges M and both can be freely positioned to any desired position, as it is demonstrated by broken lines. The drilling units 6*a*, 6*b* may be turned in direction T relative to transverse turning axis 8. The disclosed rock drilling rig 1 may be utilized for drilling drill holes 9 to rock surfaces locating above, laterally and in angular positions, and directions of the drilled holes 9 may vary.

Further, in some cases, the entire boom system may be moved laterally relative to a turning axis 10 in order to facilitate positioning. The positioning and drilling process may be controlled automatically under control of a control unit CU or in a computer aided manner together with an operator. The control unit CU may be provided with a drilling or bolting plan and the drill holes 9 are drilled to planned positions and directions.

Figure 2:
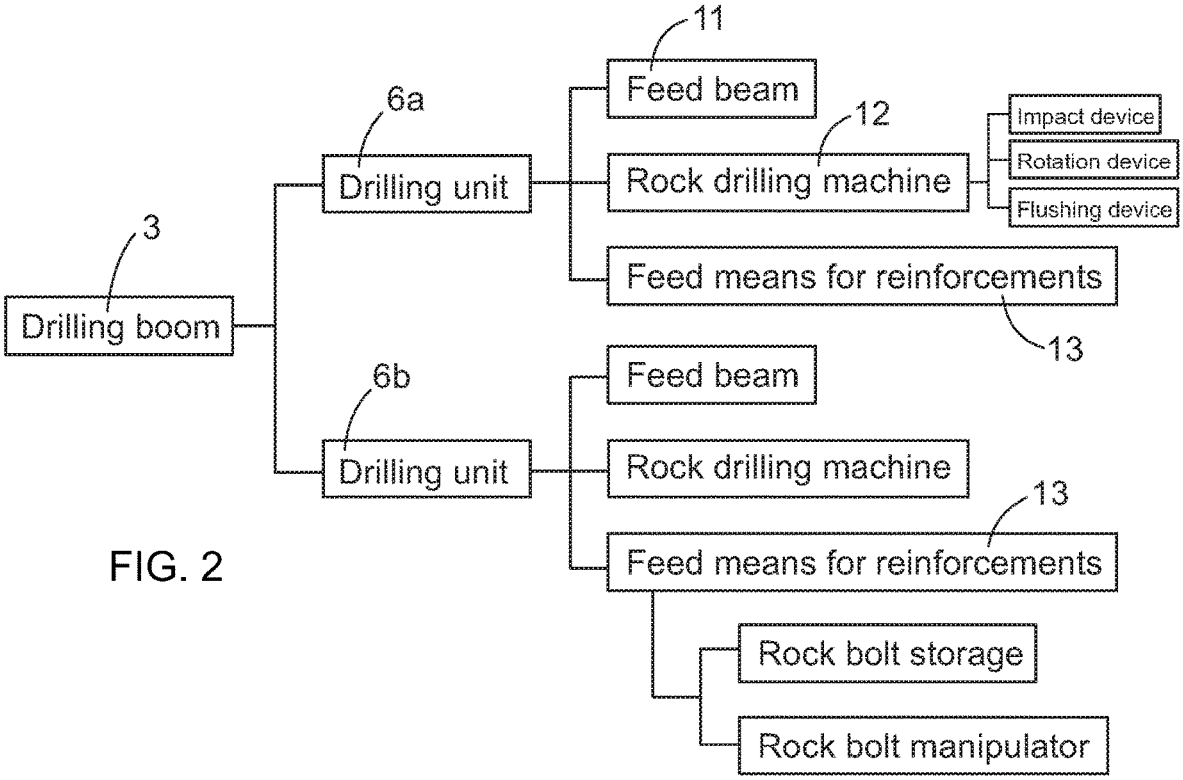
FIG. 2 is a schematic diagram showing possible components of the disclosed arrangement.

FIG. 2 discloses that both drilling units 6*a*, 6*b* may include a feed beam 11 and a rock drilling machine 12 supported thereon. The rock drilling machine 12 may include an impact device for generating impact pulses to a drilling tool, and a rotating device for rotating the tool around its longitudinal axis. The rock drilling machine 12 may further include a flushing device for flushing drilling cuttings away from the drilled hole. When the drilling units 6*a*, 6*b* are intended for reinforcing the rock surface, they may be provided with feed means 13 for feeding reinforcements to the drilled drill holes. The feed means 13 may include a feed storage, such as a rock bolt magazine, and feed manipulator.

Figure 3:
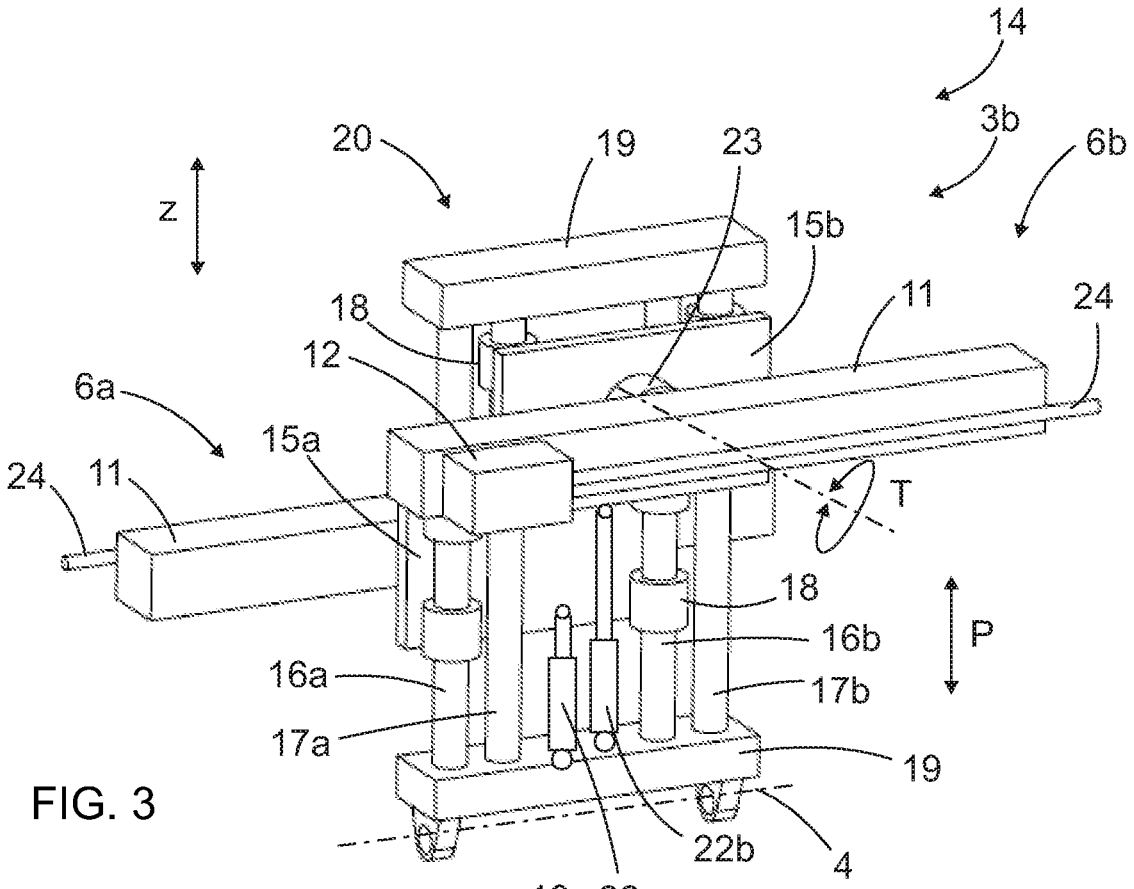
FIG. 3 is a schematic side view of an arrangement having a boom part provided with two longitudinally movable drilling units.

FIG. 3 discloses a rock drilling arrangement 14 including two rock drilling units 6*a*, 6*b* mounted on carriages 15*a*, 15*b*, which are movable along direction P independently relative to a second boom part 3*b*. A first carriage 15*a* is supported on two first guide bars 16*a*, 16*b* and a second carriage 15*b* is supported on two second guide bars 17*a*, 17*b*. The carriages 15*a*, 15*b* may be provided with slide bearing elements 18 or other bearing arrangements. The guide bars 16*a*, 16*b* may be round bars or tubes arranged between two transverse frame parts 19. Thus, in the shown embodiment, a frame 20 of the second boom part 3*b* includes only the guide bars 16, 17 in the longitudinal direction. However, in some cases there may be separate longitudinal beams between outer ends of the transverse beams and these bars are not serving as guide bars.

Figure 4:
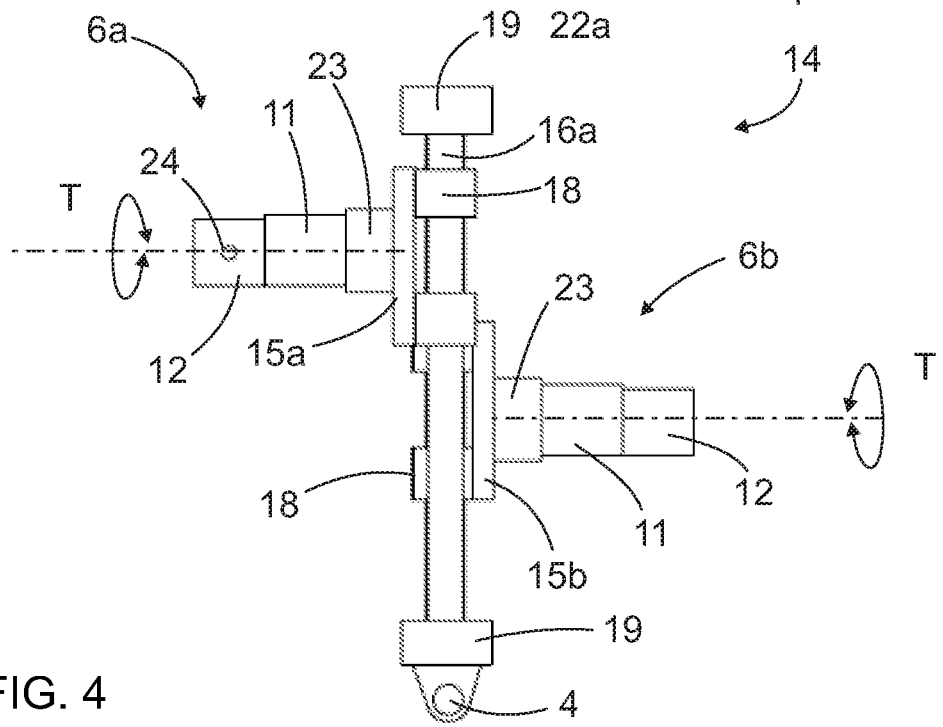
FIG. 4 is a schematic top view of the arrangement of FIG. 3.

The guide bars 16, 17 serve as the elongated guide elements 7 mentioned above in connection with FIG. 1. A first actuator 22*a* moves the first carriage 15*a* and a second actuator 22*b* moves the second carriage 15*b*. The actuators 22 may be hydraulic cylinders. Further, between the carriages 15 and the rock drilling units 6 are rotation units 23 for turning along T the drilling units 6 to different angular positions. The drilling units 6 include feed beams 11 and rock drilling machines 12 with drilling tools 24. FIG. 4 is a top view of the same apparatus 14.

Figure 5:
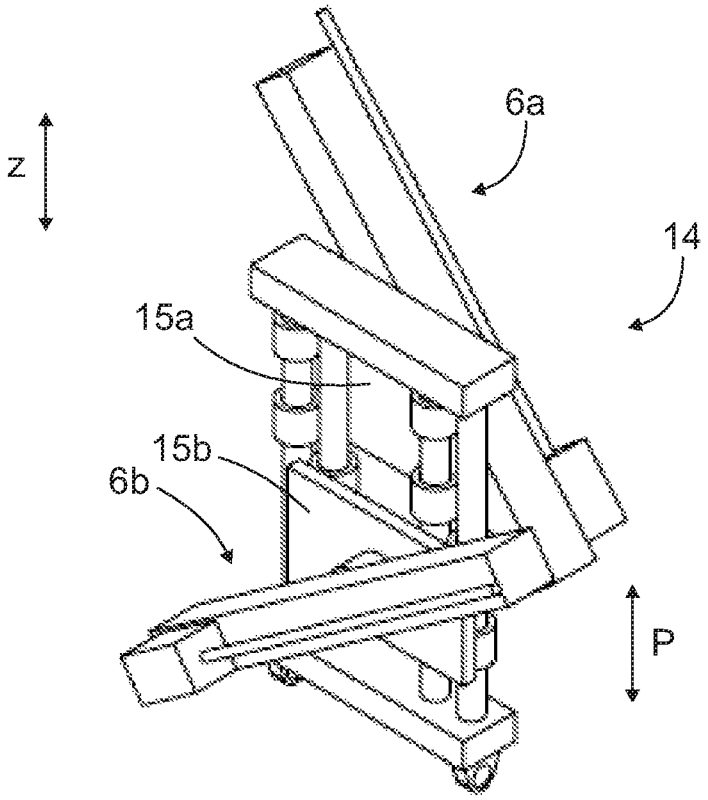
FIGS. 5 and 6 are schematic side views showing the solution of the arrangement of FIGS. 3 and 4 at different position and orientation situations.
Figure 6:
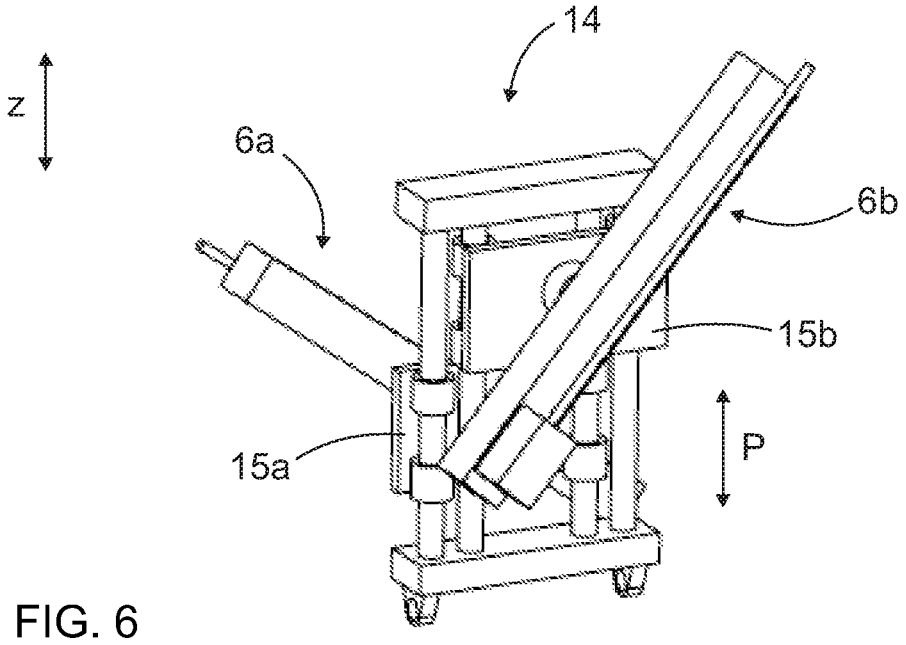

FIGS. 5 and 6 disclose the apparatus 14 of FIGS. 3 and 4 in different operational positions. In FIG. 5 the second drilling unit 6*b* is driven to its lower position and the first drilling unit 6*a* is at its upper position. In FIG. 6 the situation is vice versa. It is also possible that both drilling units 6 are at their upper or lower position, or at any vertical position within the movement range. FIGS. 5 and 6 also show that the drilling units 6 may be orientated in a desired manner.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A rock drilling arrangement comprising:

a drilling boom; and two rock drilling units supported movably on the boom, each of the rock drilling units being mounted on a carriage, wherein the carriages are each movable independently relative to the boom, wherein between each of the carriages and the rock drilling units are located separate rotation units arranged for turning the rock drilling units independently relative to the boom, and wherein the carriages are configured to be moved in a longitudinal direction of the boom, and rotation axes of the rotation units are perpendicular relative to the movement direction of the carriages.

2. The rock drilling arrangement as claimed in claim 1, wherein both rock drilling units have a moving range in the longitudinal direction of the drilling boom, the rock drilling units being independently movable in the longitudinal direction of the drilling boom for the full moving range all of the time.

3. The rock drilling arrangement as claimed in claim 1, wherein at least one of the two rock drilling units includes a feed means arranged for feeding reinforcing components to a drill hole drilled by a rock drilling machine of the rock drilling unit.

4. The rock drilling arrangement as claimed in claim 1, wherein the boom includes a first boom part connectable to a movable carrier of a rock drilling rig, and a distal second boom part, wherein between the boom parts is a joint arranged to permit the distal second boom part to be turned relative to the first boom part, and wherein the rock drilling units are mounted on opposing side surfaces of the second boom part and are movable in a longitudinal direction of the second boom part.

5. The rock drilling arrangement as claimed in claim 1, wherein the boom includes a first boom part connectable to a carrier of a rock drilling rig and a distal second boom part, and wherein the boom is configured to be orientated during the operation so that the second boom part is orientated transversally relative to the first boom part.

6. The rock drilling arrangement as claimed in claim 1, wherein the boom includes a first boom part connectable to a carrier of a rock drilling rig, and a distal second boom part and wherein the second boom part comprises:

a frame;

at least one first elongated guide element supported by the frame;

at least one second elongated guide element supported by the frame;

a first one of the carriages being supported linearly movably on the first guide element;

a second one of the carriages being supported linearly movably on the second guide element;

at least one first actuator arranged to move the first one of the carriages relative to the frame; and at least one second actuator arranged to move the second one of the carriages relative to the frame.

7. A rock drilling rig comprising:

a movable carrier; and a drilling boom and two rock drilling units according to claim 1, wherein the two rock drilling units are supported on the drilling boom.

8. A method of drilling drill holes to a rock surface by a rock drilling arrangement including a drilling boom and two rock drilling units supported on the drilling boom, and wherein the two rock drilling units are separately moved relative to the drilling boom, the method including the steps of:

positioning at least part of the drilling boom vertically;

moving the two rock drilling units vertically relative to the drilling boom for positioning them in desired vertical positions;

moving two rock drilling units in a longitudinal direction of the drilling boom; and executing the movements of the two rock drilling units independently relative to each other.

9. The method as claimed in claim 8, wherein the drilling units are arranged to execute movements in a full linear movement range at all times during the drilling.

10. The method as claimed in claim 8, wherein one of the drilling units is arranged to move freely in the longitudinal direction of the drilling boom simultaneously whilst the other drilling unit executes a drilling work cycle.

* * * * *